US008488992B2

(12) United States Patent
Kadota et al.

(10) Patent No.: US 8,488,992 B2
(45) Date of Patent: Jul. 16, 2013

(54) DEVELOPMENT DEVICE, PROCESS CARTRIDGE, AND IMAGE FORMING APPARATUS

(75) Inventors: Ichiro Kadota, Kanagawa (JP); Kunihiro Ohyama, Tokyo (JP); Masayuki Yamane, Kanagawa (JP); Takeshi Uchitani, Kanagawa (JP); Satoru Yoshida, Kanagawa (JP); Takuya Seshita, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 260 days.

(21) Appl. No.: 12/981,731

(22) Filed: Dec. 30, 2010

(65) Prior Publication Data

US 2011/0176820 A1 Jul. 21, 2011

(30) Foreign Application Priority Data

Jan. 15, 2010 (JP) ..... 2010-007405

(51) Int. Cl.
*G03G 15/08* (2006.01)

(52) U.S. Cl.
USPC ..... 399/119; 399/256

(58) Field of Classification Search
USPC ..... 399/58, 119, 254
See application file for complete search history.

(56) References Cited

U.S. PATENT DOCUMENTS

| | | | | |
|---|---|---|---|---|
| 6,421,517 | B1 * | 7/2002 | Nishino et al. | 399/254 |
| 7,412,190 | B2 | 8/2008 | Kadota et al. | |
| 7,515,856 | B2 | 4/2009 | Ohyama | |
| 7,957,681 | B2 * | 6/2011 | Shigehiro | 399/271 |
| 7,995,934 | B2 * | 8/2011 | Suzuki | 399/30 |

FOREIGN PATENT DOCUMENTS

| | | | |
|---|---|---|---|
| JP | 10186988 | A * | 7/1998 |
| JP | 11133744 | A * | 5/1999 |
| JP | 2000181213 | A * | 6/2000 |
| JP | 2005-266511 | | 9/2005 |
| JP | 2007033990 | A * | 2/2007 |
| JP | 2008-257213 | | 10/2008 |

* cited by examiner

*Primary Examiner* — David Gray
*Assistant Examiner* — Carla Therrien
(74) *Attorney, Agent, or Firm* — Oblon, Spivak, McClelland, Maier & Neustadt, L.L.P.

(57) ABSTRACT

A development device includes a toner-containing chamber for containing supplied toner having an interior wall, a developer-containing chamber for containing developer including toner and carrier communicating with the toner-containing chamber; and a transport screw to transport the supplied toner from the toner-containing chamber to the developer-containing chamber, disposed in the toner-containing chamber so that there is no gap between the outer edge of the transport screw and the interior wall of the toner-containing chamber in a portion lower than a level of the supplied toner in the toner-containing chamber.

18 Claims, 7 Drawing Sheets

DEVELOPMENT DEVICE, PROCESS CARTRIDGE, AND IMAGE FORMING APPARATUS

CROSS-REFERENCE TO RELATED APPLICATIONS

This patent specification claims priority from Japanese Patent Applications No. 2010-007405, filed on Jan. 15, 2010 in the Japan Patent Office, which is hereby incorporated by reference herein in its entirety.

BACKGROUND OF THE INVENTION

1. Field of the Invention

The present invention relates to a development device, a process cartridge that includes the development device, and an image forming apparatus such as a copier, a printer, a facsimile machine, a plotter, a multi-function machine, and the like that incorporates the process cartridge.

2. Description of the Background Art

In general, electrophotographic image forming apparatuses, such as copiers, printers, facsimile machines, or multifunction devices including at least two of those functions, etc., include a latent image carrier on which an electrostatic latent image is formed and a development device to develop the latent image with developer. In electrophotographic image forming apparatuses, two-component developer consisting essentially of toner and carrier particles is widely used.

Recently, downsizing is required in image forming apparatuses using electrophotographic method, such as copiers and printers, for example, for using the image forming apparatus personally, and accordingly, downsizing is sought for development devices in the image forming apparatuses.

In order to satisfy this demand, disposable development devices and process cartridges are widely used. More specifically, the disposable development device can be replaced entirely with a new one after the developer in the development device is consumed. The process cartridge houses the development device, a latent image carrier, such as a photoreceptor on which a latent image of a document image is formed, and a cleaning device that removes the residual toner.

However, the above-described compact development device has a smaller capacity for the developer consisting essentially of toner and magnetic carrier, which means that the agitation space of the developer has to be made more compact. In addition, recently, as the diameter of the toner particles that comprise the toner has become smaller to form better-quality images, it becomes increasingly difficult to disperse the toner that is supplied to the development device into the developer uniformly and to charge the toner uniformly. Failure to disperse the supplied toner into the developer sufficiently can cause the supplied toner that has not been charged enough to slide on surface of the developer. As a result, when the above-described toner is transported to a developing range by a development roller, image failure, such as, scattering in the backgrounds of output images and fluctuation in the image density may be caused. These image failures tend to be significant when the amount of the supplied toner is increased, for example, when documents whose image ratio is high are continuously printed.

In order to solve theses image failures arising from insufficient agitation of the supplied toner, various methods of supplying toner to the development device have been proposed. Thus, for example, in a development device proposed in JP-2008-257213-A, in order to prevent slippage of the supplied toner, the toner is supplied to the development device by submerging the toner into a lower portion of a developer agitation path through a toner transport path. In this example, the slippage of the toner on the surface of the developer can be prevented because the toner goes under the developer.

In another development device proposed in JP-2005-266511-A, the toner is supplied not by dropping the toner directly to a two-component developer transport path, but by transporting the toner to a toner transport path separated from the developer transport path, and the supplied toner is transported by a screw through the toner transport path to the developer transport path. Then, the toner is mixed with the developer in the developer transport path. In this example, the dispersibility and charging ability of the supplied toner can be improved compared with the configuration in which the toner is supplied to the developer by dropping.

However, in these examples, especially when the development device is left for a long period under high-temperature and high-humidity conditions, the toner in the toner transport path more easily coagulates compared with the toner that does not pass through the toner transport path but is directly mixed with the developer. Such toner coagulation causes image failures such as substandard output images, in which toner is partly absent creating white lines, and output images in which the toner coagulation appears as a lump in an output image on the transfer sheet.

In view of the foregoing, there is market demand for a development device capable of preventing toner from coagulating in the developer-containing portion and improving image quality.

SUMMARY OF THE INVENTION

In view of the foregoing, one illustrative embodiment of the present invention provides a development device that develops a latent image formed on a latent image carrier with developer. The development device includes a toner-containing chamber for containing supplied toner having an interior wall, a developer-containing chamber for containing developer including toner and carrier communicating with the toner-containing chamber, and a transport screw to transport the supplied toner from the toner-containing chamber to the developer-containing chamber facing the interior wall of the toner-containing chamber either directly or via an another member disposed in the toner-containing chamber so that there is no gap between the outer edge of the transport screw and the interior wall of the toner-containing chamber in a portion lower than a level of the supplied toner in the toner-containing chamber.

Another illustrative embodiment of the present invention provides a process cartridge includes at least one of a latent image carrier, a charging device, and a cleaning device for the latent carrier, and the development device described above.

Another illustrative embodiment of the present invention provides an image forming apparatus that includes a latent image carrier on which a latent image is formed, a sheet feeder to feed a sheet, and the development device described above.

BRIEF DESCRIPTION OF THE DRAWINGS

A more complete appreciation of the disclosure and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
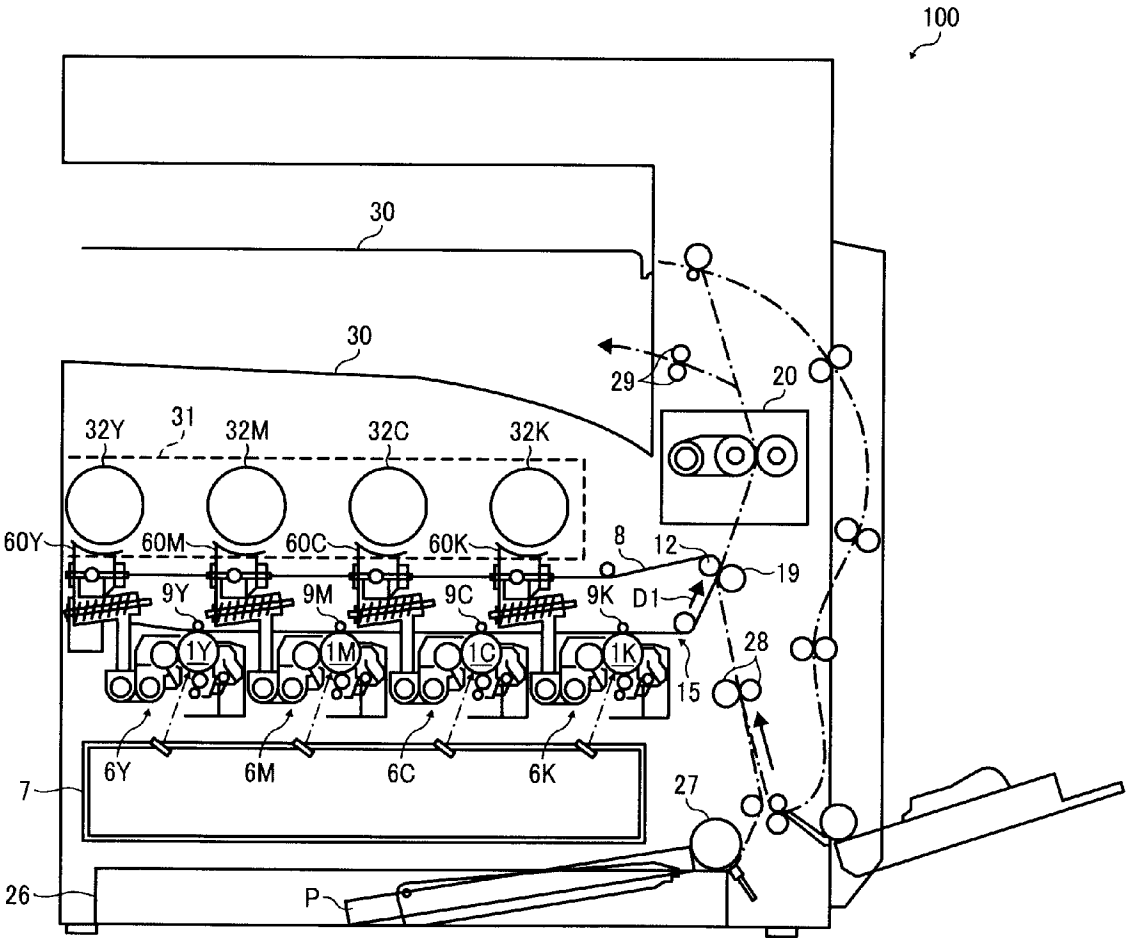
FIG. 1 is a schematic diagram illustrating a configuration of an electrophotographic printer according to an illustrative embodiment.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1 through FIG. 4C, an image forming apparatus that is a multicolor laser printer (hereinafter referred to as a multicolor printer) according to an illustrative embodiment of the present invention is described. It is to be noted that although the image forming apparatus of the present embodiment is a printer, the image forming apparatus of the present invention is not limited to a printer.

Figure 2:
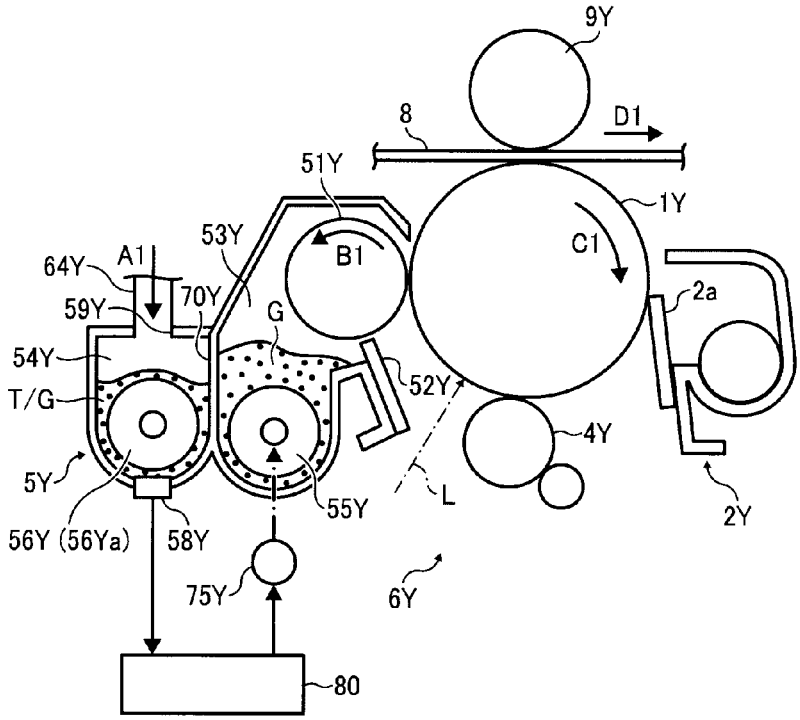
FIG. 2 shows a schematic configuration of an image forming unit for producing yellow toner images.

FIG. 1 is a schematic diagram illustrating an image forming apparatus 100, and FIG. 2 shows a schematic configuration of an image forming unit 6Y for producing yellow toner images.

Initially, a basic configuration and operation of the entire multicolor printer (image forming apparatus) 100 are described below.

In an upper portion of a casing of the multicolor printer 100, a toner container holder 31 is provided. The toner container holder 31 includes four toner containers 32Y, 32M, 32C, and 32K (corresponding to yellow, magenta, cyan, black color) that are releasably installed in the toner container holder 31. The respective toner containers 32Y, 32M, 32C, and 32K contain toner T to be supplied to image forming units.

Beneath the toner container holder 31, an intermediate transfer unit 15 is provided. The intermediate transfer unit 15 includes an intermediate transfer belt 8, serving as an intermediate transcriptional body. Beneath the intermediate transfer belt 8, four image forming units 6Y, 6M, 6C and 6K for forming black, magenta, cyan, and yellow (hereinafter also simply "Y, M, C, and Y") single-color toner images, respectively, arranged in parallel to each other, facing the intermediate transfer belt 8, receptively.

In addition, four toner supply devices 60Y, 60M, 60C, and 60K are arranged between the toner containers 32Y, 32M, 32C, and 32K and the respective image forming units 6Y, 6M, 6C, and 6K. Thus, the toner T contained in the toner containers 32Y, 32M, 32C, and 32K is supplied to four development devices 5Y, 5M, 5C, and 5K in the image forming unit 6Y, 6M, 6C, and 6K, that is, the development device 5Y, 5M, 5C, and 5K is replenished with the toner T in the respective toner container 32Y, 32M, 32C, and 32K.

As shown in FIG. 1, beneath the image forming units 6Y, 6M, 6C, and 6K, an exposure device 7 is disposed. The exposure device 7 includes laser light sources, not shown, such as laser diodes that irradiate respective photoreceptor drums 1Y, 1M, 1C, and 1K in the respective image forming units 6Y, 6M, 6C, and 6K with laser beams L in accordance with image data. Due to this exposure process, electrostatic latent images for Y, M, C, and K are respectively formed on the photoreceptor drums 1.

Beneath the exposure device 7, a sheet feeder 26 that contains a transfer material P, such as transfer sheet, is provided.

It is to be noted that the subscripts Y, M, C, and K attached to the end of each reference numeral indicate only that components indicated thereby are used for forming yellow, magenta, cyan, and black images, respectively. However, each image forming unit 6K, 6M, 6C, and 6Y has a similar configuration except for the color of toner used therein as an image forming material.

Using the image forming unit 6Y as an example, the configurations of the image forming units 6K, 6M, 6C, and 6Y are described below.

As shown in FIG. 2, the image forming unit 6Y includes the drum shaped photoreceptor (photoreceptor drum) 1Y, a drum cleaning device 2Y, a charging device 4Y, the development device 5Y, and a discharging device, not shown. In the image forming unit 6Y, an electrophotographic image forming process including a charging process, an exposure process, and a cleaning process is executed on the photoreceptor drum 1Y, and thus the yellow image is formed on the photoreceptor drum 1Y.

In FIG. 2, the charging device 4Y uniformly charges an outer circumferential surface of the photoreceptor drum 1Y that is rotated clockwise indicated by arrow C1 in FIG. 2 by a drive motor, not shown, in the charging process. Then, the surface of the photoreceptor drum 1Y thus uniformly charged is exposed and scanned by the laser beam L emitted from the exposure device 7 shown in FIG. 1 in the exposure process, after which it carries an electrostatic latent image for yellow. The electrostatic latent image for yellow is developed into a Y toner image by the development device 5Y that uses the Y toner in the development process.

Then, the surface of the photoreceptor drum 1Y on which the toner image has been formed reaches a position (primary transfer position) facing the intermediate transfer belt 8 and a primary-transfer bias roller 9Y, and the toner image on the photoreceptor drum 1Y is transferred onto the intermediate transfer belt 8 at the primary transfer position by applying a transfer bias to the surface of the photoreceptor drum 1Y (a primary transfer process). At this time, a small amount of toner that has not been transferred onto the intermediate transfer belt 8 remains on the photoreceptor drum 1Y. Subsequently, the surface of the photoreceptor drum 1Y reaches a position facing the drum cleaning device 2Y and the toner remaining on the surface of the photoreceptor drum 1Y is mechanically removed by a cleaning blade 2*a* (the cleaning process).

Finally, the surface of the photoreceptor drum 1Y reaches a position facing the discharging device and electric charges remaining on the surface of the photoreceptor drum 1Y are discharged.

Thus, the image forming process on the photoreceptor drum 1Y is completed.

Other image forming units 6M, 6C, and 6K, similarly to the above description, respectively form magenta, cyan, and black toner images on the photoreceptor drums 1M, 1C, and 1K.

More specifically, the exposure device 7 includes the laser light sources, not shown, such as laser diodes that irradiate the respective photoreceptor drums 1M, 1C, and 1K in the image forming units 6M, 6C, and 6K with the laser beams L in accordance with image data. In the exposure device 7, the laser beams L emitted from the laser light sources are deflected by a polygon mirror driven by a motor, not shown, so that the laser beams L scan the surfaces of the photoreceptor drums 1M, 1C, and 1K via multiple optical lenses and mirrors.

Subsequently, while a surface (outer circumferential surface) of the intermediate transfer belt 8 is moved through primary transfer nips for magenta, cyan, and black, the M, C, and K toner images on the photoreceptor drums 1M, 1C, and 1K are primarily transferred and superimposed one on another on the surface of intermediate transfer belt 8. Therefore, a four-color superimposed toner image (hereinafter referred to as a four-color toner image) is formed on the surface of the intermediate transfer belt 8.

As shown in FIG. 1, the intermediate transfer unit 15 includes the intermediate transfer belt 8, four primary-transfer bias rollers 9Y, 9M, 9C, and 9K, a secondary-transfer backup roller 12, multiple tension rollers, and an intermediate transfer cleaning device, not shown. The intermediate transfer belt 8 that is a seamless belt is stretched around and supported by the multiple rollers and is rotated in a counterclockwise direction in FIG. 1 by rotating the secondary-transfer backup roller 12.

The intermediate transfer belt 8 is sandwiched between the primary-transfer bias rollers 9Y, 9M, 9C, and 9K and the photoreceptor drums 1Y, 1M, 1C, and 1K to form the respective primary transfer nips therebetween. Each primary-transfer bias roller 9 applies transfer bias that has a reverse polarity (e.g., positive polarity) to the polarity of the toner to a backside (inner circumferential face) of the intermediate transfer belt 8.

The intermediate transfer belt 8 sequentially passes through the primary transfer nips formed by the primary-transfer bias rollers 9Y, 9M, 9C, and 9K and the respective photoreceptor drums 1Y, 1M, 1C, and 1K pressing against each other via the intermediate transfer belt 8 while rotating in the direction indicated by arrow D1 shown in FIG. 1. Thus, the toner images on the respective photoreceptor drums 1Y, 1M, 1C, and 1K are primarily transferred onto the intermediate transfer belt 8 and superimposed one on another thereon.

Then, the intermediate transfer belt 8 onto which the toner images have been transferred and superimposed one on another thereon reaches a position facing a secondary transfer roller 19. A secondary transfer nip is formed at the position where the intermediate transfer belt 8 is sandwiched between the secondary transfer backup roller 12 and the secondary transfer roller 19. The four-color toner image formed on the intermediate transfer belt 8 is collectively transferred to the transfer sheet P at the secondary transfer nip (a secondary transfer process). At this time, residual toner that is not transferred onto the transfer sheet P but adheres to the surface of the intermediate transfer belt 8 after the intermediate transfer belt 8 has passed through the secondary transfer nip is removed therefrom by the intermediate transfer cleaning device (not shown).

Thus, the transfer processes that are performed on the intermediate transfer belt 8 are completed.

Along these processes, the transfer sheet P is carried to the secondary transfer nip from the sheet feeder 26 positioned at a lower part of casing of the image forming apparatus 100 via a feed roller 27, a pair of registration rollers 28, and so on.

Specifically, the plural transfer sheets P are stacked and stored in the sheet feeder 26. When the feed roller 27 is rotated counterclockwise shown in FIG. 1, a top transfer sheet P is carried to a position between the pair of registration rollers 28. The transfer sheet P carried to the pair of registration rollers 28 is temporarily stopped at a roller nip position sandwiched by the pair of registration rollers 28 whose rotation is stopped. Then, the pair of registration rollers 28 is rotated again, timed to coincide with formation of the multicolor image on the intermediate transfer belt 8, and thus the transfer sheet P is carried to the secondary transfer nip. Thus, a desired multicolor image is formed on the transfer sheet P.

Subsequently, the transfer sheet P onto which the multicolor image has been transferred in the secondary transfer nip is carried to a fuser 20. The four-color toner image is fixed on a surface of the transfer sheet P with heat and pressure while the transfer sheet P passes through rollers in the fuser 20.

Thereafter, the transfer sheet P is discharged outside of the image forming apparatus 100 via a pair of discharge sheet rollers 29. A stack portion 30 is located on an upper side of the image forming apparatus 100. The transfer sheets P discharged outside by the pair of discharge sheet rollers 29 are sequentially stacked on the stack portions 30.

Thus, the image forming process in the image forming apparatus 100 is completed.

Next, with reference to FIG. 2, a structure and operations of the development device 5Y in the image forming unit 6Y are described in detail below.

The development device 5Y includes a development roller 51Y disposed facing the photoreceptor drum 1Y, a doctor blade 52Y facing the development roller 51Y, developer-containing chambers 53Y and 54Y, a first transport screw 56Y, a second transport screw 55Y, a toner-containing chamber 57Y (shown in FIG. 3), and a toner concentration detector (sensor) 58Y for detecting a toner concentration of developer G.

The development device 5Y is internally substantially divided by a partition into the first developer-containing chamber 54Y, the second developer-containing chamber 53Y, the toner-containing chamber 57Y, and a roller space in which the development roller 51Y is contained. The first transport screw 56Y extends inside the first developer-containing chamber 54Y as well as the toner-containing chamber 57Y, and the second transport screw 55Y is contained in the second developer-containing chamber 53Y. The toner concentration detector 58Y is provided in a lower portion of the toner-containing chamber 57Y.

The development roller 51Y includes a fixed magnet (not shown) provided inside the development roller 51Y and a sleeve (not shown) that is the outermost portion of the development roller 51 and is rotated around the magnet. The developer G (two-component developer, see FIG. 2) consisting essentially of carrier particles C (toner carrier) and toner particles T is contained in the developer-containing chambers 53Y and 54Y.

Figure 3:
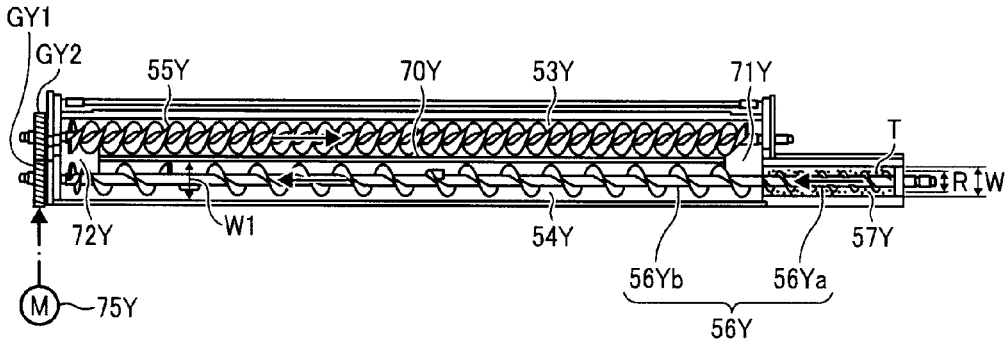
FIG. 3 schematically illustrates horizontal cross sections of the development device shown in FIG. 2, viewed in the longitudinal direction.

FIG. 3 schematically illustrates horizontal cross sections of the development device shown in FIG. 2, viewed in the longitudinal direction. In FIG. 3, the developer-containing chambers 53Y and 54Y are partially but not completely separated by a wall 70Y, and the first developer-containing chamber 54Y is connected to the second developer-containing chamber 53Y via communication paths (openings) 71Y and 72Y (shown in FIG. 3).

The developer G in the first developer-containing chamber 54Y moves to the second developer-containing chamber 53Y via the second communication path 72Y, and the developer G in the second developer-containing chamber 53Y moves to the first developer-containing chamber 54Y via the first communication path 71Y. The toner-containing chamber 57Y is formed on an upstream side from the first communication path 71Y in a direction in which the developer G is transported in the first developer-containing chamber 54Y.

The toner-containing chamber 57Y communicates with a toner drop route 64Y via a supply inlet 59Y formed on an upper side of the toner-containing chamber 57Y.

As shown in FIG. 3, a gear GY1 is fixed on an end of the first transport screw 56Y opposite to the toner-containing chamber 57Y, and a gear GY2 is fixed on an end of the second transport screw 55Y. The gear GY1 engages the gear GY2. When one of the gears GY1 and GY2 rotates, the other of the gears GY1 and GY2 rotates in an opposite direction to the direction in which the one of the gears GY1 and GY2 rotates.

The one of the gears GY1 and GY2 receives a transmission force from a driving motor 75Y, serving as a driving source. The driving motor 75Y is electronically connected to a controller 80 shown in FIG. 2 and drives the one of the transport screws 56Y and 55Y to rotate in a forward direction in accordance with a control signal from the controller 80. The controller 80 may be a computer including a central processing unit (CPU) and a memory. The computer performs various types of control processing according to programs stored in the memory as functions of the controller 80.

The controller 80 is connected to the toner concentration detector 58Y through a signal line and receives toner concentration data from the toner concentration detector 58Y.

The operation of the above-described development device 5Y is described below.

The sleeve of the development roller 51Y rotates in a direction indicated by arrow B1 shown in FIG. 2. Then, the developer G carried on the development roller 51Y by a magnetic field formed by the magnet is moved on the development roller 51Y while rotating with the sleeve. The developer G in the development device 5Y is adjusted so that a toner ratio in the developer (toner concentration) is set within a predetermined range.

More specifically, the toner-containing chamber 57Y is replenished with toner as appropriate via the toner supply device 60Y as the toner in the development device 5Y is consumed.

Subsequently, the toner T in the toner-containing chamber 57Y is transported to the first developer-containing chamber 54Y by rotating the first transport screw 56Y and is agitated and mixed with the developer G. Subsequently, the developer G thus agitated in the first developer-containing chamber 54Y is moved to the second developer-containing chamber 53Y via the second communication path 72Y (see FIG. 3). Then, the developer G in the second developer-containing chamber 53Y is transported to the first communication path 71Y by rotating the second transport screw 55Y, and the developer G thus transported is moved back to the first developer-containing chamber 54Y via the first communication path 71Y. Thus, the developer G is circulated in the two developer-containing chambers 53Y and 54Y, in a direction indicated by solid arrows shown in FIG. 3.

At this time, the toner T in the developer G is adhered to the carrier C by frictional electrification between the toner T and carrier C and is carried on the development roller 51Y with the carrier C by the magnetic field formed on the development roller 51Y.

The developer G carried on the development roller 51Y is transported to a position (a doctor gap) facing the doctor blade 52Y in a direction indicated by the arrow B1 shown in FIG. 2. After the doctor blade 52Y regulates a layer thickness (amount) of the developer G carried on the development roller 51Y, the developer G carried on the development roller 51Y is transported to a position (a development range) facing to the photoreceptor drum 1Y. Then, the toner T in the developer G is adhered to the latent image formed on the photoreceptor drum 1Y by the electrical field formed in the development range. Subsequently, the residual toner remained on the development roller 51Y is transported to a position above the second developer-containing chamber 53Y as the sleeve of the development roller 51Y rotates, and the toner thus transported is released back from the development roller 51Y to the second developer-containing chamber 53Y.

Next, behavior of the toner T supplied to the toner-containing chamber 57Y is described in detail below.

As described above with reference to FIG. 3, the developer-containing chamber 54Y is communicated with the toner-containing chamber (toner transport path) 57Y in the vicinity of the first communication opening 71Y. The first transport screw 56Y extending in both the developer-containing chamber 54Y and the toner-containing chamber 57Y includes a toner transport portion 56Ya positioned in the toner containing chamber 57Y and a developer transport portion 56Yb positioned in the developer-containing chamber 54Y.

Figure 4A:
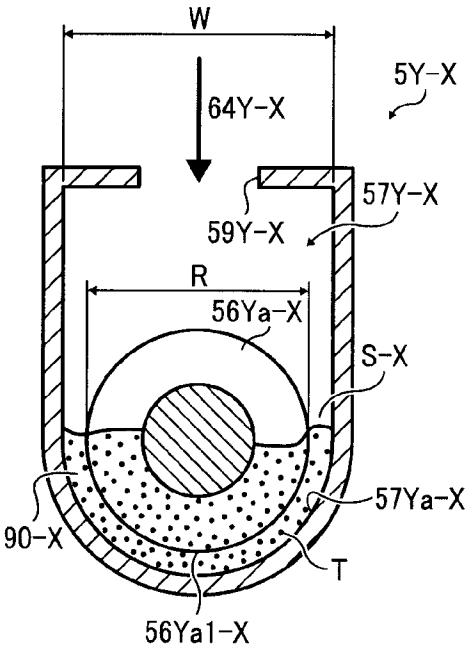
FIG. 4A is a cross-sectional diagram illustrating a toner-containing chambers according to a comparative example.
Figure 4B:
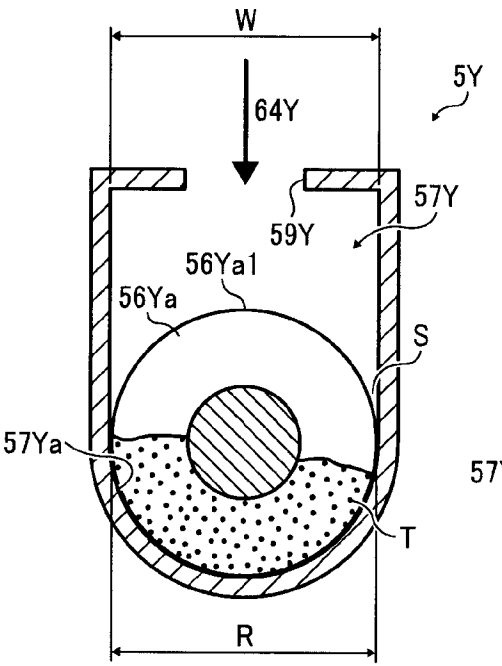
FIG. 4B is a cross-sectional diagram illustrating a toner-containing chambers according to a first embodiment.
Figure 4C:
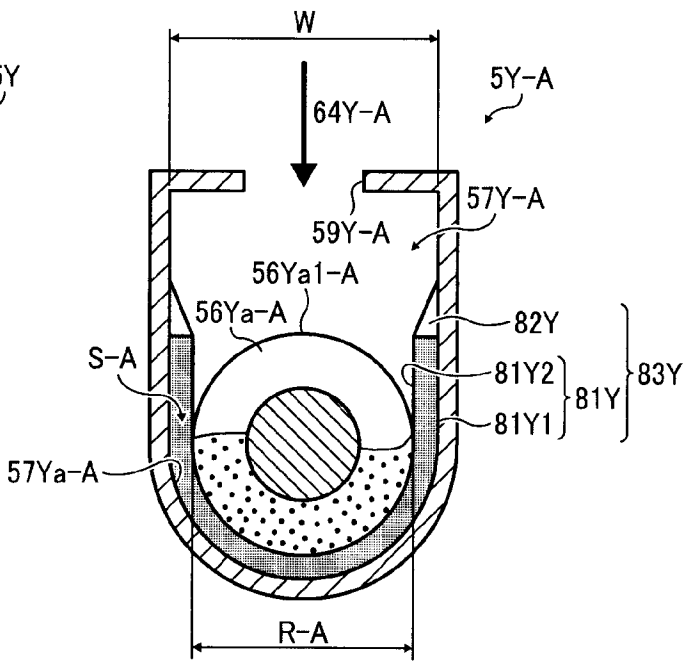
FIG. 4C is a cross-sectional diagram illustrating a toner-containing chambers according to a second embodiment.

FIG. 4A shows a toner-containing chamber 57Y-X according to a comparative example, and FIGS. 4B and 4C are cross-sectional diagrams respectively illustrating the toner-containing chambers 57Y and 57Y-A according to first and second embodiments described below. In FIGS. 4A through 4C, an interior wall 57Ya or 57Ya-x of the toner-containing chamber 57Y or 57Y-X is circular arc-shaped in a portion in which a height of the interior wall 57Ya or 57Ya-x is lower than a level of the supplied toner T.

As shown in FIG. 3, a width W between the interior walls 57*a* on both sides of (inner width) the toner-containing chamber 57Y and an external diameter R of the toner transport portion 56Ya are set narrower and thinner than a width W1 (inner width) of the developer-containing chamber 54Y and an external diameter R1 of the developer transport portion 56Yb, respectively. The external diameter R of the toner transport portion 56Ya is set thinner than the width W of the interior wall 57Ya of the toner-containing chamber 57Y.

As shown in FIG. 4A, when a clearance gap S-X is present between an outer edge 56Ya1-X of a toner transport portion 56Ya-X and an interior wall 57Ya-X of the toner-containing chamber 57Y-X, the toner T located in the gap S-X is not transported to a developer-containing chamber 54Y-X even when the toner transport portion 56Ya-X of a first transport screw 56Y-X rotates, and thus, an immobile layer 90 of the toner is formed. The toner T in the immobile layer 90 is easily compressed when left for a long period under high-temperature and high-humidity conditions, more likely to coagulate.

Then, for example, when the development device 5Y-X is vibrated, the toner T of the immobile layer 90 adhering to the interior wall 57Ya-X is un-piled, and toner coagulation thus un-piled from the immobile layer 90 is transported to the developer-containing chamber 53Y via the developer-containing chamber 54Y as the first transport screw 56Y rotates.

As a result, substandard output images in which toner is partly absent creating white lines may be produced because the coagulated toner is caught in (clogged in) the doctor gap between the development roller 51Y and the doctor blade 52Y or, when the toner coagulation is not too wide to clog the doctor gap, the coagulated toner can be transferred to the photoreceptor drum 1 as is, and therefore, the toner coagulation appears as a lump in an output image on the transfer sheet P.

As the immobile layer 90 of the toner becomes thicker, that is, the gap S-X between the interior wall 57Ya-X and the outer edge 56Ya1-X of the toner transport portion 56Ya-X becomes wider, big coagulation is more likely to be generated.

It is to be noted that, in this embodiment, the doctor gap between the doctor blade 52Y and the development roller 51Y is set to 0.4 mm. In view of the foregoing, it is preferable that a gap S between the interior wall 57Ya of the toner-containing chamber 57Y and the outer edge 56Ya of the toner transport portion 56Ya is set narrower.

(First Embodiment)

FIG. 4B shows the toner-containing chamber 57Y according to the first embodiment. In the first embodiment, as shown in FIG. 4B, in order to set the gap between the interior wall 57Ya of the toner-containing chamber 57Y and the outer edge 56Ya1 of the toner transport portion 56Ya to almost zero, the external diameter R of the toner transport portion 56Ya is smaller than an inner diameter of the interior wall 57Ya of the toner-containing chamber 57Y by 0 mm to about 0.1 mm.

With this configuration, the toner T supplied to the toner-containing chamber 57Y can be transported to the developer-containing chamber 54Y (see FIG. 3) without forming the immobile layer 90, and then, the toner T spreads into the carrier and is electrically charged. Accordingly, the toner can be prevented from coagulating, and good quality images can be obtained.

More specifically, when the gap S between the outer edge 56Ya1 of the toner transport portion 56Ya and the interior wall 57Ya of the toner-containing chamber 54Y (toner transport path) is set extremely small, ideally zero, the immobile toner 90 (dead toner) is removed and the toner that receives stress and is not transported is not generated, and generation of the toner coagulation can be prevented.

(Second Embodiment)

FIG. 4C shows the toner-containing chamber 57Y-A in a development device 5Y-A according to the second embodiment.

In the first embodiment, considering the runout accuracy of the toner transport portion 56Ya of the first transport screw 56Y and the tolerance in size the toner-containing chamber 57Y in manufacturing, it is difficult to fully fill the gap S between the interior wall 57Ya of the toner-containing chamber 57Y and the outer edge 56Ya1 of the toner transport portion 56Ya at low cost.

In order to fill the gap S more effectively, in the present embodiment as shown in FIG. 4C, an external diameter R of a toner transport portion 56Ya-A is set, for example, smaller than the internal diameter of an interior wall 57Ya-A of the toner-containing chamber 57Y-A by about 1.0 mm, that is, a predetermined clearance gap S-A is allowed between an outer edge 56Ya1-A of the toner transport portion 56Ya-A and the interior wall 57Ya-A of the toner-containing chamber 57Y-A although it is extremely small. In order to fill the predetermined gap S-A, a gap filler 83Y is provided between the interior wall 57Ya-A of the toner-containing chamber 57Y-A and the outer edge 56Ya1-A of the toner transport portion 56Ya-A so that the gap filler 83Y conforms to the shape of the interior wall 57Ya-A of the toner-containing chamber 57Y-A. The gap filler 83Y includes a sponge 81Y and a film 82Y. The sponge 81Y, serving as an elastic body, includes a first face 81Ya to be attached to the interior wall 57Ya-A and a second face 81Yb-A disposed facing the outer edge 56Ya1-A of the toner transport portion 56Ya-A. The second face 81Yb deforms while contacting the outer edge 56Ya1-A of the transport portion 56Ya1-A. The film 82Y, serving as a friction reducer, is formed of a thin resin, such as, polyethylene terephthalate (PET). The film 82Y is interposed between the second face 81Yb of the sponge 81Y and the outer edge 56Ya1-A of the toner transport portion 56Ya-A and attached to the second face 81Yb of the sponge 81Y, and thus, no gap is created.

With this configuration, because the sponge 81Y covered with the film 82Y presses against and closely contacts the toner transport portion 56Ya, the gap S-A between the interior wall 57Ya-A of the toner-containing chamber 57Y-A and the outer edge 56Ya1-A of the toner transport portion 56Ya-A is fully filled. Accordingly, the toner T supplied to the toner-containing chamber 57Y-A is transported to the developer-containing chamber 54Y-A without forming the immobile layer 90, and then, the toner T thus transported spreads into the carrier and is electrically charged. Therefore, the toner-containing chamber 57Y-A according to the present embodiment can prevent the toner from coagulating and form images whose quality is better at an affordable cost, as compared with a case in which the toner-containing chamber 57Y is manufactured with higher degree of accuracy.

If the outer edge 56Ya1-A of the toner transport portion 56Ya-A directly contacts the sponge 81Y, the frictional resistance offered to the toner transport portion 56Ya-A during the first transport screw 56Y rotates is increased, and then, the load on the driving motor 75Y is increased. Furthermore, the sponge 81Y may be damaged over time and separated sponge parts may be mixed with the developer G.

However, in the present embodiment, since the thin film 82Y is provided between the toner transport portion 56Ya-A and the sponge 81Y, the frictional resistance between the sponge 81Y and the rotating toner transport portion 56Ya-A of the first transport screw 56Y-A can be reduced, and the load to the driving motor 75Y can be reduced. In addition, the duration of the sponge 81Y can be improved, and no separated sponge is mixed with the developer G.

Herein, in order to only fill the gap S-A, the gap filler 83Y may include only the sponge 81Y without the thin film 82Y.

In addition, since the gap S-X presents between the outer edge 56Ya1-X of the toner transport portion 56Ya-X and the interior wall 57Ya-X of the toner-containing chamber 57Y-X in a comparative example shown in FIG. 4A, by just installing the gap filler 83Y including the sponge 81Y and the film 82Y (or only sponge 81Y) in existing types of development devices (parts), the parts in of the existing type of development devices can be used, and therefore, manufacturing cost can be further reduced.

Furthermore, when a used development device is detached from a collected image forming apparatus for reuse, the toner coagulation in the toner-containing chamber can be prevented by attaching the gap filler 83Y to the development device to be reused after being disassembled and cleaned, and therefore, development performance can be improved as compared with the device before reuse.

An experiment was carried out with the development devices according to the first and second embodiments shown in FIGS. 4B and 4C, respectively installed in the image forming unit 6Y (or process cartridge) in the image forming apparatus. In this experiment, a chart having an image area of 20% that requires supply of a lot of toner was formed on 1000 transfer sheets S, after which the development device was left for two months at a temperature of 40° C. and humidity of 70%.

With this condition, substandard images that include white lines caused by coagulated toner clogging the doctor gap between the development roller 51Y and the doctor blade 52Y or the toner coagulation itself as a lump were not produced.

It is to be noted that, one or more of the components of the image forming unit 6Y (e.g., the photoreceptor drum 1Y, the cleaning member 2Y, the charging device 4Y, and the development device 5Y) may be united as a single unit (i.e., process cartridge) removably installable to the image forming apparatus 1. In such a configuration, similar effects can be also attained.

(Third Embodiment)

Next, a development device 5-B according to a third embodiment is described below with reference to FIGS. 5, 6A, and 6B.

In the configurations according to the first embodiment and the second embodiment, because the transports screws 55Y and 56Y are rotated in only one direction (forward direction) by the driving motor 75Y, the toner T supplied through the toner drop route 64Y and the toner inlet 59Y is moved in only one direction (clockwise direction in FIG. 3). Therefore, the developer G used for forming images does not enter the toner-containing chamber 57Y.

Figure 5:
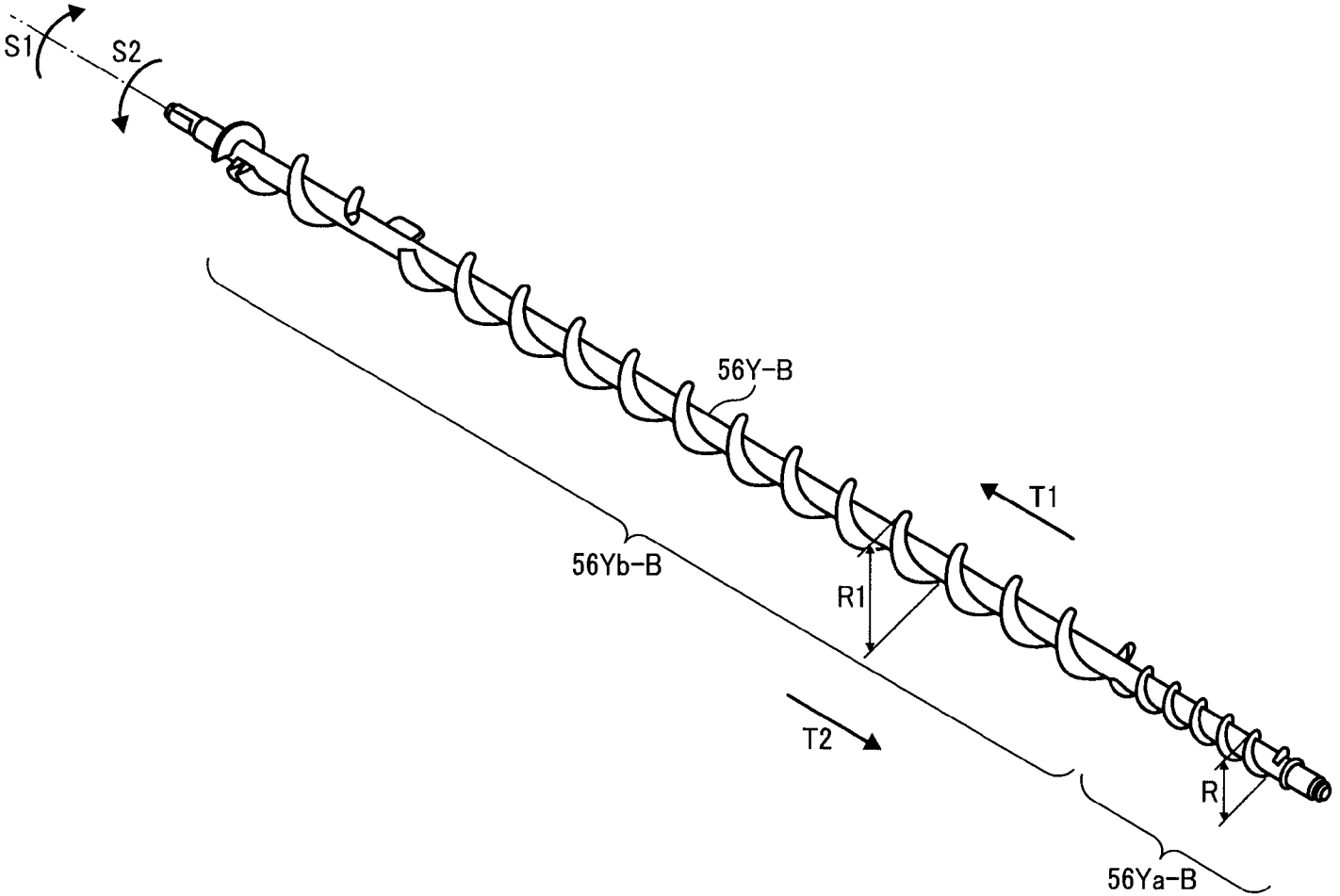
FIG. 5 is a schematic diagram illustrating the toner transport screw to transport toner in the toner-containing chamber and developer in the developer-containing chamber according to a third embodiment.

In FIG. 5, arrow T1 indicates a direction in which the toner T in the toner-containing chamber 57Y is transported to the developer-containing chamber 54Y, arrow S1 indicates a "first direction" that means a rotation direction of the first transport screw 56Y for transporting the toner T in the toner-containing chamber 57Y to the developer-containing chamber 54Y, arrow T2 indicates a direction opposite to the direction indicated by the arrow T1, that is, a direction in which the developer G in the developer-containing chamber 54Y is transported to the toner-containing chamber 57Y, and arrow S2 indicates a "second direction" that means a rotation direction of the first transport screw 56Y opposite to the first rotation direction that is, for transporting the developer G in the developer-containing chamber 54Y to the toner-containing chamber 57Y. In the third embodiment, a first transport screw 56Y-B is rotatable in the first direction and the second direction and a driving motor 75Y-B can drive forwardly and reversely so that the first transport screw 56Y-B is rotated in the first direction and the second direction.

In this configuration, the forward drive of the driving motor 75Y-B causes the first transport screw 56Y-B to rotate in the first direction for transporting the toner T in the toner-containing chamber 57Y to the developer-containing chamber 54Y, and the reverse drive of the driving motor 75Y-B causes the first transport screw 56Y-B to rotate in the second direction for transporting the developer G in the developer-containing chamber 54Y to the toner-containing chamber 57Y.

As described above, when the driving motor 75Y-B reversely drives, the first transport screw 56Y-B transports the developer G to the toner-containing chamber 57Y, and as a result, the developer G can be mixed with the supplied toner T in the toner-containing chamber 57Y.

However, when the first transport screw 56Y-B is rotated in the second direction (reverse direction) just one time, it is possible that the supplied toner T in the toner-containing chamber 57Y is brought up by the developer G transported thereto, and thus a portion in which the supplied toner T is not mixed with the developer G can be present. In view of the foregoing, the driving motor 75Y-B repeats the reverse drive and the forward drive, and therefore, the supplied toner T can be mixed with the developer G entirely. The driving motor 75Y-B is controlled by a controller 80-B shown in FIG. 6B.

Figure 6A:
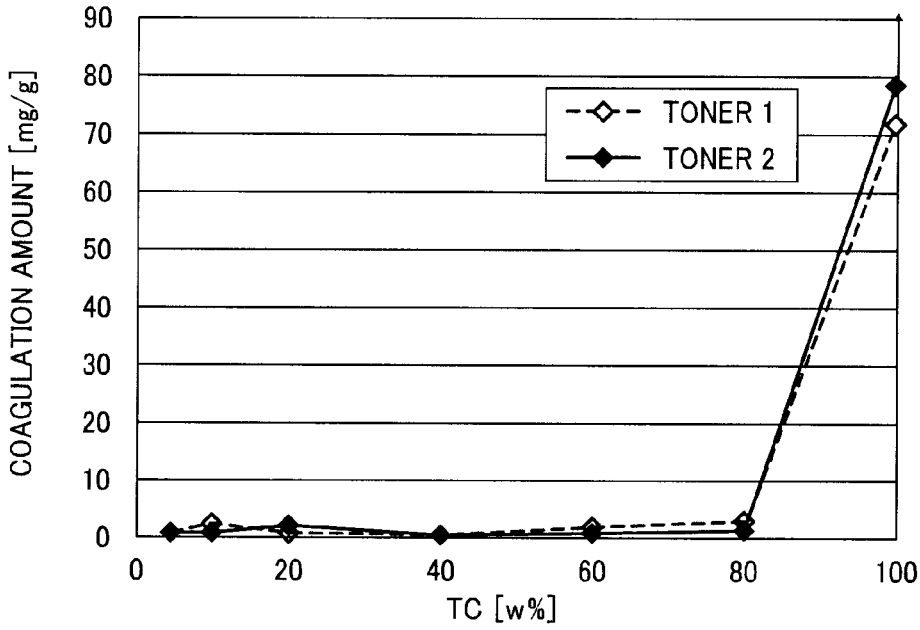
FIG. 6A shows relation between toner concentration and coagulation amount according to the third embodiment.

Herein, FIG. 6A shows relation between toner concentration (%) and coagulation amount (mg/g) when the toner T is subjected to a temperature of 50° C. and humidity of 80% for one month. The coagulation amount (mg/g) is obtained by dividing remaining toner weight after the toner was put through a sieve by toner weight before the toner was put through the sieve. In this experiment, the toner coagulation is formed by the remaining toner and the carrier on the sieve after the toner (developer) is put through the sieve whose mesh grid is 106 μm.

In FIG. 6A, toner 1 means black toner (K), and toner 2 means yellow toner (Y). The toner 1 and toner 2 are similar to each other except pigments that generate color difference. As shown in FIG. 6A, when the toner concentration is set equal to or less than 80% in a mixing section, the generation of the toner coagulation can be dramatically reduced.

Figure 6B:
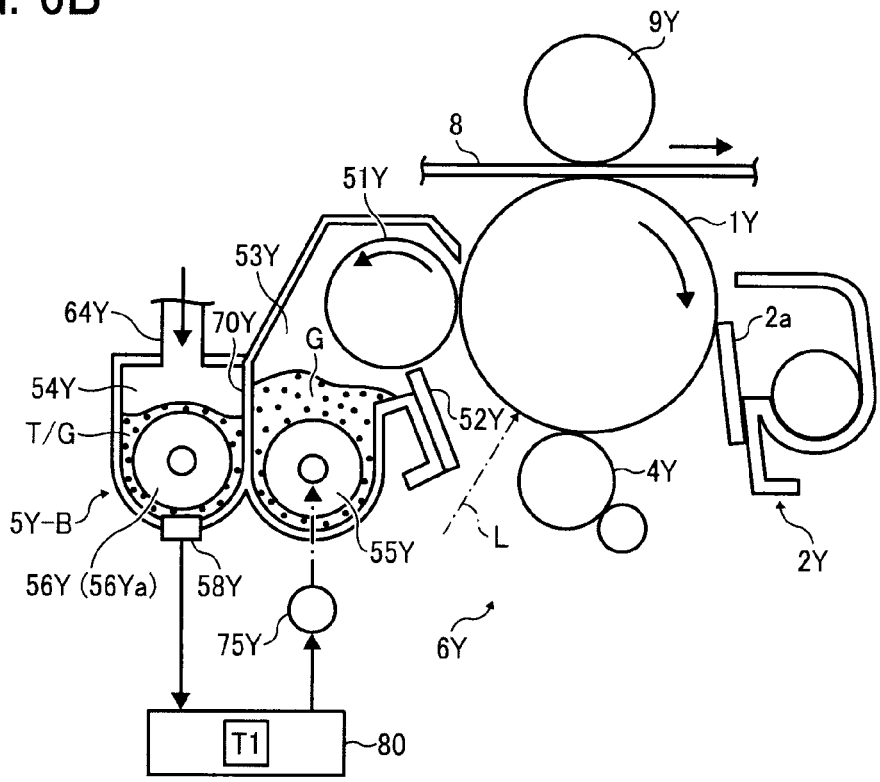
FIG. 6B shows an expanded diagram illustrating a development device according to the third embodiment.

Therefore, in the present embodiment, in the controller 80-B shown in FIG. 6B, a predetermined toner concentration value T1 is set equal to and less than 80%, and the driving motor 75Y-B repeats forward drive and reverse drive until the toner concentration detected by the toner concentration detector 58Y-B reaches (is decreased to) the toner concentration value T1.

The predetermined toner concentration value T1 can be stored in the controller 80-B in advance shown in FIG. 6B.

(Variation of the Third Embodiment)

Figure 7:
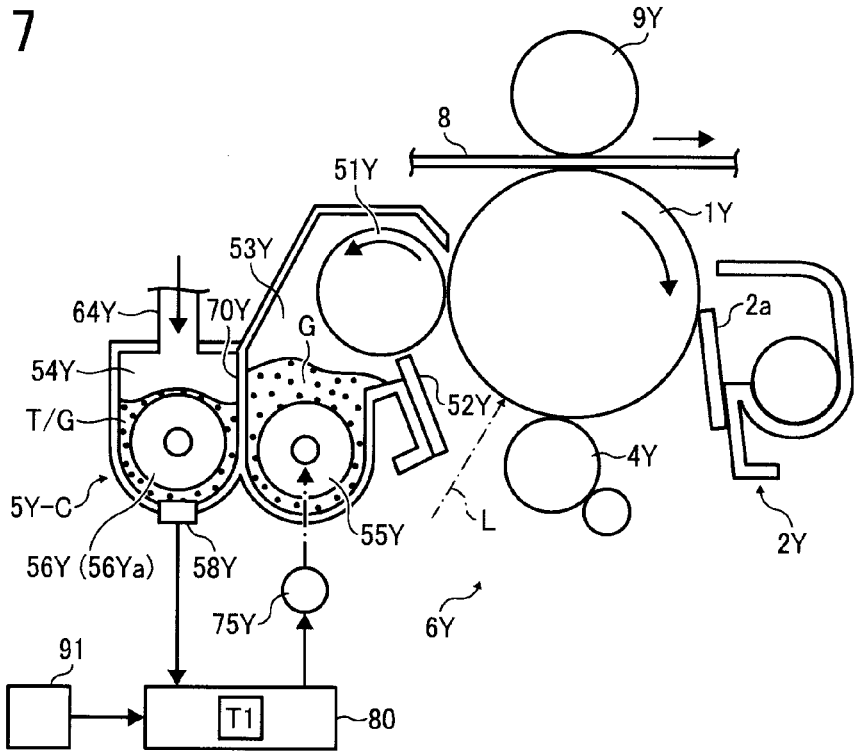
FIG. 7 shows an expanded diagram illustrating a development device in which a toner concentration is set arbitrary according to a variation of the third embodiment.

Alternatively, as a variation of a third embodiment shown in FIG. 7, a setting device 91 that commands a controller 80-C to adjust the toner concentration value T1 is connected to the controller 80-C, and the toner concentration value T1 is set by operating the setting device 91 arbitrarily by the user.

When the toner concentration value T1 can be arbitrarily set as in the variation of the third embodiment as described above, by driving a driving motor 75Y-C (75Y-B) forwardly and reversely before the image forming apparatus is shipped out from a factory, the image forming apparatus can be transported by ship whose cargo space is in conditions at high temperature and humidity for a long time. Therefore, the transport cost of the image forming apparatus can be reduced as compared with the transport cost using the airlines, and finally, total cost until the image forming apparatus thus manufactured and transported reaches the consumer can be reduced.

In addition, before the user of the image forming apparatus (color laser printer) enters a long vacation, a maintenance operator or the user can operate the setting device 91 so that the driving motor 75Y-C drives forwardly and reversely, and as a result, the generation of the toner coagulation during long vacation can be obviated.

(Fourth Embodiment)

Next, a development device 5Y-D according to a fourth embodiment is described below with reference to FIGS. 5 and 8.

Figure 8:
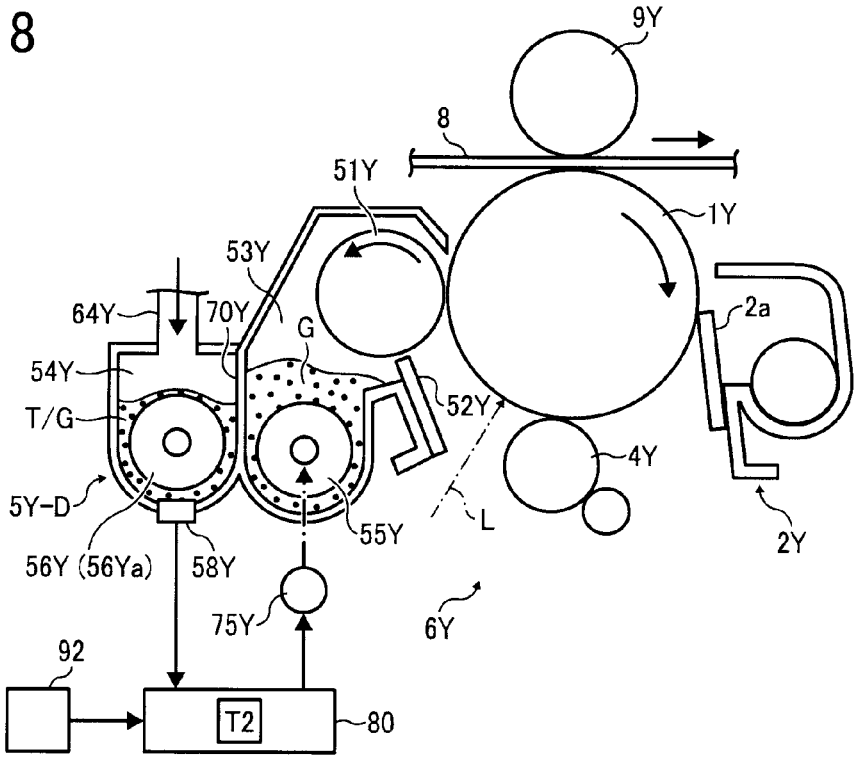
FIG. 8 shows an expanded diagram illustrating a development device in which a toner concentration value is set considering temperature and humidity according to a fourth embodiment.

Although the toner concentration value T1 is set by the setting device 91 in the variation described above, in the present embodiment, as shown in FIG. 8, a temperature-humidity detector 92 that detects temperature and humidity is connected to a controller 80-D in addition to a toner concentration detector 58Y-D connected to the controller 80-D, and the controller 80-D thus connected controls a driving motor 75Y-D.

The controller 80-D controls the driving motor 75Y-D so that the first transport screw 56Y-B rotates alternately in the first direction and the second direction. In addition, when the temperature and humidity detected by the temperature-humidity detector 92 are within a temperature-humidity setting values (ranges) T2 set in the controller 80-D in advance, the controller 80-D drives the driving motor 75Y-D so that the first transport screw 56Y-B rotates alternately in the first direction and the second direction until the toner concentration is decreased to 80% or less. Examples of the temperature-humidity setting value T2 include a temperature upper limit of, for example, 35 degrees Celsius, that is, toner storage temperature upper limit, and a humidity upper limit of, for example, 90% or greater (relative humidity RH). When these temperatures and humidity are detected by the temperature-humidity detector 92, the first transport screw 56Y-B rotates alternately in the first direction and the second direction. Accordingly, even when user uses the image forming apparatus 100 including the development device 8-D, in a condition in which the toner is easily coagulated, generation of the toner coagulation can be obviated.

(Fifth Embodiment)

Figure 9:
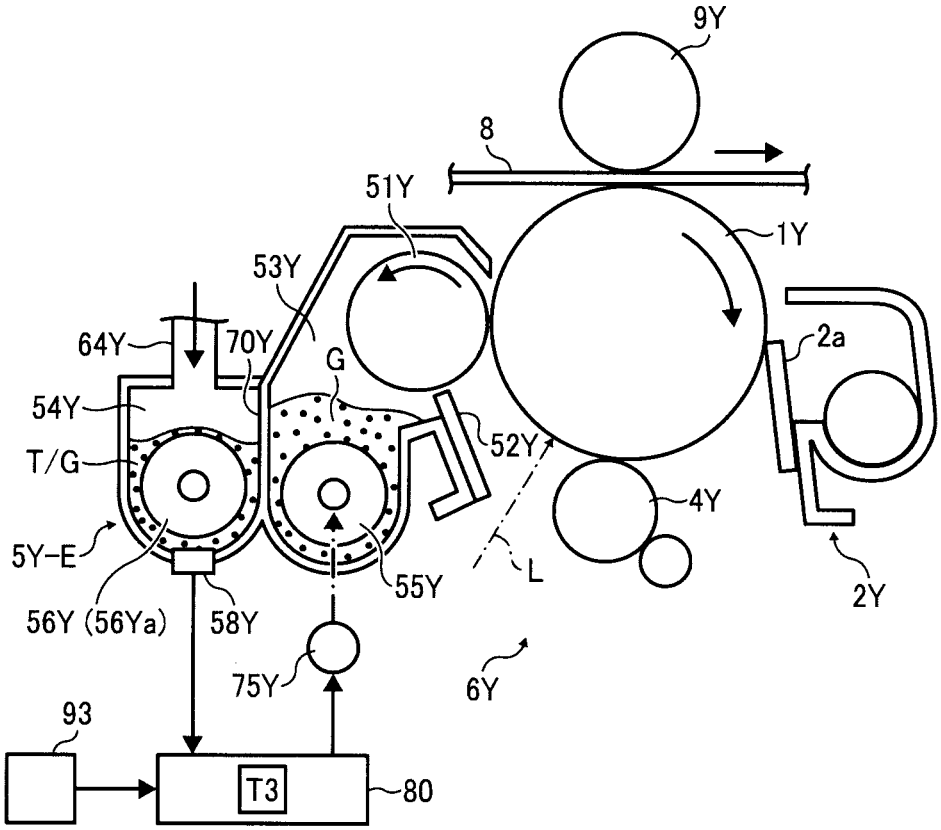
FIG. 9 shows an expanded diagram illustrating a development device in which a toner concentration value is set considering non-operating time according to a fifth embodiment.

Next, a development device 5Y-E according to a fifth embodiment is described below with reference to FIGS. 5 and 9. In FIG. 9, a timer 93 functioning as a gauge that counts a non-operating time of the development device 8-E is connected to a controller 80-E, in addition to a toner concentration detector 58Y-E connected to the controller 80-E, and the controller 80-E thus connected controls a driving motor 75Y-E.

The controller 80-E controls the driving motor 75Y-E so that the first transport screw 56Y rotates alternately in the first direction and the second direction.

When the counting time of the timer 93 reaches a set time T3 of the non-operating time that is set in the controller 80-E in advance, the controller 80-E drives the driving motor 75Y-E so that the first transport screw 56Y-B rotates alternately in the first direction and the second direction until the toner concentration is decreased to 80% or less.

The measure start of the timer 93 is at the time immediately after the development device 5Y-E stops operating. For example, the set time T3 of the non-operating time may be a time period depending on which the controller judges that the user enters a long vacation, for example two days (48 hours), after the development device 5Y-E stops forming image, that is, a limit of time within which the development device 5Y-E can be left unused.

When the counting time of the timer 93 reaches the set time T3 of the upper limit of the un-operating time, that is, the counting time of the timer 93 reaches 48 hours or more, the controller 80-E recognizes that the user is in long vacation and drives the driving motor 75Y-E so that the first transport screw 56Y-B rotates alternately in the first direction and the second direction. As a result, the development device 5Y-E can respond to the long-time non-operating condition, and the generation of the toner coagulation during long vacation can be prevented.

(Sixth Embodiment)

In the third through fifth embodiments, although the first transport screw 56Y-B (56Y-C, 56Y-D, and 56Y-E) rotates alternately in the first direction and the second direction after the development device enters predetermined conditions, in a sixth embodiment, the controller 80B (80C, 80D, and 80E) can also control the driving motor 75Y-B (75Y-C, 75Y-D, and 75Y-E) so that the first transport screw 56Y-B rotates in the only first direction after the first transport screw 56Y-B rotates alternately in the first direction and the second direction, the first transport screw 56Y-B rotates in the first direction.

When the first transport screw 56Y-B rotates alternately in the first direction and the second direction under certain specified predetermined condition, the fluctuations in the toner concentration of the developer used for forming image may occur. However, after the first transport screw 56Y-B rotates alternately in the first direction and the second direction, the first transport screw 56Y-B rotates in the only first direction, that is, developer is agitated, and the fluctuations in the toner concentration of the developer used for forming image can be alleviated.

(Variation of Sixth Embodiment)

In a variation of the sixth embodiment, the first transport screw 56Y-B rotates in the only first direction after the first transport screw 56Y rotates alternately in the first direction and the second direction, and subsequently, a process control is performed. The process control is to adjust the toner concentration (in other words, image density) of the toner image formed on the photoreceptor drum 1Y, the intermediate transfer belt 8, and the transfer sheet P.

In the sixth embodiment described above, in order to alleviate the fluctuations in the toner concentration, the first transport screw 56Y-B rotates in the only first direction and the developer is agitated after the first transport screw 56Y-B rotates alternately in the first direction and the second direction, and the toner concentration of the developer used for forming image is increased. Accordingly, the charging amount in toner obtained dividing electronic charge Q by toner mass M (Q/M) is decreased, and in a process condition (development potential) before agitating the developer, an excessive amount of toner may adhere to the latent image, as compared with the target toner adhesion amount, which is not desirable.

In order to solve this problem, in this variation, the process control to adjust image density is performed after the first transport screw 56Y-F2 rotates in the only first direction, and therefore, the process condition after the toner concentration of the developer used for forming image is increased can be determined. As a result, on-target toner adhesion amount can be obtained, and the generation of the toner coagulation can be prevented before happens. Thus, good image can be stably attained.

An aspect of the present invention provides a development device. In the development device, the transport screw rotates in only the first direction after the transport screw rotates alternately in the first direction and the second direction, and subsequently, a process control to adjust image density is performed.

Although, in the description above, the configuration of only the yellow color development device 5Y and image forming unit 6Y is described, the above-described features of the present specification can adapt to other colors development device 5 and image forming units 6. It is to be noted that the configuration of the present specification is not limited to that shown in FIG. 1. For example, the above-described features of the present specification may adapt to printers including an electrophotographic image forming device as well as other types of image forming apparatuses, such as copiers, facsimile machines, multifunction peripherals (MFP), and the like.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device to develop a latent image formed on a latent image carrier with developer, the development device comprising:

a toner-containing chamber for containing supplied toner, having an interior wall;

a developer-containing chamber for containing developer including toner and carrier, communicating with the toner-containing chamber;

a transport screw to transport the supplied toner from the toner-containing chamber to the developer-containing chamber, disposed in the toner-containing chamber; and a gap filler interposed between the outer edge of the transport screw and the interior wall of the toner-containing chamber in a portion lower than a level of the supplied toner in the toner-containing chamber so that there is no gap between the outer edge of the transport screw and the interior wall of the toner-containing chamber in a portion lower than a level of the supplied toner in the toner-containing chamber, the gap filler attached to the interior wall of the toner-containing chamber.

2. The development device according to claim 1, wherein the gap filler comprises an elastic body that deforms while contacting the outer edge of the transport screw, and the elastic body has a first face attached to the interior wall of the toner-containing chamber and a second face positioned facing the outer edge of the screw.

3. The development device according to claim 2, further comprising a friction reducer provided between the second face of the elastic body of the gap filler and the outer edge of the transport screw.

4. The development device according to claim 1, wherein the transport screw is rotatable in a first direction for transporting the supplied toner in the toner-containing chamber to the developer-containing chamber and a second direction for transporting the developer in the developer-containing chamber to the toner-containing chamber, the development device further comprising a driving source to drive the transport screw to rotate alternately in the first direction and the second direction.

5. The development device according to claim 4, further comprising:

a toner concentration detector to detect a concentration of the toner in the toner-containing chamber, provided in the toner-containing chamber or on an outer wall of the toner-containing chamber; and a controller to control the driving source to cause the transport screw to rotate alternately in the first direction and the second direction until the toner concentration detected by the toner concentration detector is decreased to a predetermined toner concentration value.

6. The development device according to claim 5, further comprising a temperature-humidity detector to detect temperature and humidity in the toner containing-chamber, wherein, when temperature and humidity detected by the temperature-humidity detector are within a predetermined temperature and humidity range, the controller controls the driving source to cause the transport screw to rotate alternately in the first direction and the second direction until the toner concentration detected by the toner concentration detector is decreased to 80% or less.

7. The development device according to claim 5, further comprising a gauge that measures non-operating time of the development device, wherein, when the non-operating time of the development device detected by the gauge reaches a predetermined extent, the controller controls the driving source to cause the transport screw to rotate alternately in the first direction and the second direction until the toner concentration detected by the toner concentration detector is decreased to 80% or less.

8. The development device according to claim 5, wherein the transport screw rotates in only the first direction after the transport screw rotates alternately in the first direction and the second direction.

9. A process cartridge to form a toner image, comprising:

at least one of a latent image carrier, a charging device, and a cleaning device for the latent image carrier; and a development device comprising:

a toner-containing chamber for containing supplied toner, having an interior wall;

a developer-containing chamber for containing developer including toner and carrier, communicating with the toner-containing chamber;

a transport screw to transport the supplied toner from the toner-containing chamber to the developer-containing chamber, disposed in the toner-containing chamber; and a gap filler interposed between the outer edge of the transport screw and the interior wall of the toner-containing chamber in a portion lower than a level of the supplied toner in the toner-containing chamber so that there is no gap between the outer edge of the transport screw and the interior wall of the toner-containing chamber, the gap filler attached to the interior wall of the toner-containing chamber.

10. An image forming apparatus comprising:

a latent image carrier on which a latent image is formed;

a sheet feeder to feed a sheet; and a development device to supply developer to the latent image formed on the latent image carrier and develop the latent image, the development device comprising:

a toner-containing chamber for containing supplied toner, having an interior wall;

a developer-containing chamber for containing developer including toner and carrier, communicating with the toner-containing chamber;

a transport screw to transport the supplied toner from the toner-containing chamber to the developer-containing chamber, disposed in the toner-containing chamber; and a gap filler interposed between the outer edge of the transport screw and the interior wall of the toner-containing chamber in a portion lower than a level of the supplied toner in the toner-containing chamber so that there is no gap between the outer edge of the transport screw and the interior wall of the toner-containing chamber in a portion lower than a level of the supplied toner in the toner-containing chamber, the gap filler attached to the interior wall of the toner-containing chamber.

11. The image forming apparatus according to claim 10, wherein the gap filler of the development device comprises an elastic body that deforms while contacting the outer edge of the transport screw, the elastic body has a first face attached to the interior wall of the toner-containing chamber and a second face positioned facing the outer edge of the screw.

12. The image forming apparatus according to claim 11, further comprising a friction reducer provided between the elastic second face and outer edge of the transport screw.

13. The image forming apparatus according to claim 11, wherein the transport screw rotates in a first direction for transporting the supplied toner in the toner containing chamber to the developer-containing chamber and a second direction for transporting the developer in the developer-containing chamber to the toner-containing chamber, the development device comprising:

a driving source to drive the transport screw to rotate alternately in the first direction and the second direction.

14. The image forming apparatus according to claim 13, further comprising:

a toner concentration detector to detect a concentration of the toner in the toner-containing chamber, provided in the toner containing chamber or on an outer wall of the toner-containing chamber; and a controller to control the driving source to cause the transport screw to rotate alternately in the first direction and the second direction until the toner concentration detected by the toner concentration detector is decreased to a predetermined toner concentration value.

15. The image forming apparatus according to claim 14, further comprising a setting device to set the predetermined toner concentration value, connected to the controller.

16. The image forming apparatus according to claim 14, further comprising:

a temperature-humidity detector to detect temperature and humidity in the toner-containing chamber, wherein, when temperature and humidity detected by the temperature-humidity detector are within a predetermined temperature and humidity range, the controller controls the driving source to cause the transport screw to rotate alternately in the first direction and the second direction until the toner concentration detected by the toner concentration detector is decreased to 80% or less.

17. The image forming apparatus according to claim 14, further comprising:

a gauge that measures non-operating time of the development device, wherein, when the non-operating time of the development device detected by the gauge reaches a predetermined extent, the controller controls the driving source to cause the transport screw to rotate alternately in the first direction and the second direction until the toner concentration detected by the toner concentration detector is decreased to 80% or less.

18. The image forming apparatus according to claim 14, wherein the transport screw rotates in only the first direction after the transport screw rotates alternately in the first direction and the second direction.

* * * * *